United States Patent [19]

Schora et al.

[11] Patent Number: 4,560,547

[45] Date of Patent: Dec. 24, 1985

[54] PRODUCTION OF HYDROGEN FROM OIL SHALE

[75] Inventors: Frank C. Schora, Palatine; John C. Janka, Forest Park; Harlan L. Feldkirchner, Elk Grove Village, all of Ill.

[73] Assignee: Institute of Gas Technology, Chicago, Ill.

[21] Appl. No.: 393,194

[22] Filed: Jun. 28, 1982

[51] Int. Cl.[4] ..... C01B 3/24

[52] U.S. Cl. ..... 423/650; 423/651; 423/652; 423/653; 423/654; 423/415 A; 423/DIG. 16; 208/11 R; 48/197 R

[58] Field of Search ..... 423/650–654, 423/415 A, DIG. 16; 208/11 R; 48/197 R; 252/373

[56] References Cited

U.S. PATENT DOCUMENTS

| | | | |
|---|---|---|---|
| 2,285,276 | 6/1942 | Hemminger | 208/11 R |
| 3,489,672 | 1/1970 | Schulman et al. | 208/11 R |
| 3,565,784 | 2/1971 | Schlinger et al. | 208/11 R |
| 3,703,052 | 11/1972 | Linden | 208/11 R |
| 3,764,547 | 10/1973 | Schlinger et al. | 252/373 |
| 3,922,215 | 11/1975 | Linden et al. | 48/197 R |
| 3,985,519 | 10/1976 | Kalina et al. | 252/373 |
| 4,148,710 | 4/1979 | Burton | 252/373 |

OTHER PUBLICATIONS

L. Reh, "Fluidized Bed Processing", *Chemical Engineering Progress*, vol. 67, No. 2, pp. 58–63, Feb. 1971.

*Primary Examiner*—John Doll
*Assistant Examiner*—Jackson Leeds
*Attorney, Agent, or Firm*—Thomas W. Speckman

[57] ABSTRACT

A process for production of hydrogen from oil shale fines by direct introduction of the oil shale fines into a fluidized bed at temperatures about 1200° to about 2000° F. to obtain rapid heating of the oil shale. The bed is fluidized by upward passage of steam and oxygen, the steam introduced in the weight ratio of about 0.1 to about 10 on the basis of the organic carbon content of the oil shale and the oxygen introduced in less than the stoichiometric quantity for complete combustion of the organic carbonaceous kerogen content of the oil shale. Embodiments are disclosed for heat recovery from the spent shale and heat recovery from the spent shale and product gas wherein the complete process and heat recovery is carried out in a single reaction vessel. The process of this invention provides high conversion of organic carbon component of oil shale and high production of hydrogen from shale fines which when used in combination with a conventional oil shale hydroconversion process results in increased overall process efficiency of greater than 15 percent.

48 Claims, 2 Drawing Figures

PRODUCTION OF HYDROGEN FROM OIL SHALE

BACKGROUND OF THE INVENTION

1. Field of the Invention

This invention relates to a process for production of hydrogen from oil shale fines. The process provides high conversion of the organic carbonaceous material in oil shale to hydrogen for a wide variety of uses. In one embodiment, the hydrogen and product gases produced by the process of this invention are particularly useful in the hydroretorting and hydrogasification of oil shale to produce useful liquid and gaseous products. The process of this invention provides efficient utilization of substantially the entire amount of organic carbon in mined oil shale.

2. Description of the Prior Art

There is a recognized need for hydrogen in a wide variety of chemical processes. The process of this invention provides hydrogen for such processes and particularly advantageously provides increased efficiency in the utilization of oil shale in the production of liquid and gaseous fuels from carbonaceous materials such as oil shales.

Processes for hydrogasification of oil shales are disclosed in U.S. Pat. Nos. 3,891,403 and 3,929 615. U.S. Pat. No. 3,703,052 teaches hydrogasification of shale oil to produce pipeline quality gas wherein shale fines and spent shale with coke from the hydrogasifier are gasified in a steam-oxygen gasifier at 1500°-2100° F. and preferably 1600°-1900° F. to favor direct formation of methane and conversion of the gaseous mixture to a hydrogen-rich gas by a carbon monoxide shift reaction or by a steam-iron process and the solids recirculated to the hydrogasifier. U.S. Pat. No. 3,708,269 teaches hydrogasification of fluid fossil fuels and mixtures of fluid and solid fossil fuels to produce synthetic pipeline gas wherein spent solids from the hydrogasifier are gasified in a steam-oxygen gasifier to favor direct formation of methane and the gas mixture treated by a carbon monoxide shift reaction and purified to produce hydrogen-rich gas for hydrogasification and the solids recirculated to the hydrogasifier. One of the unexpected features of the present invention is the large amount of direct hydrogen formation from shale fines at lower temperatures.

Hydroretorting of oil shale to produce hydrocarbon liquids likewise uses a large amount of hydrogen as taught by U.S. Pat. Nos. 3,922,215; 4,003,821; and 4,075,081. U.S. Pat. No. 3,577,338 teaches a method for oil production from oil shale which simultaneously produces hydrogen as a by-product by passing oil shale through a combustion zone in a retort while continuously introducing steam and oxygen into the combustion zone. U.S. Pat. No. 4,010,092 teaches combusting spent coke containing shale in a steam-oxygen mixture resulting in steam-rich water gas for use in the oil shale retorting-gasification process. U.S. Pat. No. 4,001,105 teaches catalytic hydrocracking of carbonaceous materials using activated spent shale and forming hydrogen for the reaction in situ. The present invention does not depend upon catalytic properties of shale inorganic matrix, which may vary substantially from one shale to another.

SUMMARY OF THE INVENTION

The process of this invention produces a high yield of hydrogen from raw oil shale fines produced during the grinding and sizing of run-of-mine shale to the size required for processes such as hydroretorting and hydrogasification. The fines produced during such grinding typically amount to about 5 to 15 weight percent of the run-of-mine shale fed to the crushers. Presently, the shale fines are frequently disposed of in the mine workings and thus their energy potential is wasted and they may contribute to pollution of ground water. According to the process of this invention, oil shale fines having average diameters of less than about 0.125 inch are introduced into a fluidized reaction bed maintained within a reaction vessel at temperatures of about 1200° to about 2000° F. Introduction of the oil shale fines directly into the fluidized bed itself is an important aspect of this invention to provide rapid heat-up of the oil shale in order to have as little production as possible of liquids or gases by pyrolysis or thermal retorting as the feed shale passes through the 900° to 1400° F. temperature range. The reaction bed is maintained fluidized by upward passage of steam and oxygen, the steam being introduced in a weight ratio of about 0.1 to about 10 pounds per pound of organic carbon in the oil shale feed, and the oxygen being introduced in less than the stoichiometric quantity for complete combustion of the organic carbonaceous kerogen content of the oil shale. The steam and oxygen react with the organic carbon components of the oil shale producing spent shale and product gas comprising hydrogen and carbon monoxide. The synthesis gas may be purified and its carbon monoxide content catalytically converted to the desired hydrogen. We have found that by the process of this invention generally more than 90 percent of the organic carbon in the oil shale is converted and frequently up to 99 percent.

The process of this invention when used in an integrated hydroretorting oil shale plant may result in improvements in yields of net synthetic crude oil from oil shale in the order of 20–25 percent, as compared with prior hydrogen production methods. The process of this invention has the further advantage of essentially complete removal of kerogen and in a preferred embodiment, removal of sulfur from raw shale fines, thus eliminating their potential formation of acid-mine drainage or leaching of organic materials into underground waters. The process of this invention is especially suited to oil shales of the type having Modified Fischer Assays of less than 10 gallons of oil per ton and frequently lower than 5 gallons of oil per ton, such as shale from deposits of Devonian and Mississippian age usually found in the eastern part of the United States.

It is an object of this invention to provide a process for production of hydrogen from raw oil shale fines having conversion of greater than 90 percent and preferably greater than 95 percent of the organic carbon in the oil shale.

It is another object of this invention to provide an integrated oil shale hydrogasification or hydroliquefaction process providing overall process efficiencies which are increased by at least 15 percent.

Still another object of this invention is to provide improved land management of oil shale mining areas by increased removal of residual sulfur and organic compounds which may cause water pollution.

Yet another object of this invention is to provide high efficiency hydroconversion to useful liquid and gaseous fuels of organic carbon contained in oil shale having Modified Fischer Assay measurements of less than 10 and down to 0 by production of process required hydrogen from oil shale fines.

Another object of this invention is to provide a process for production of hydrogen from raw oil shale fines in a fluidized reaction bed which is fluidized with steam and oxygen, the oil shale fines being introduced directly into the fluidized bed.

BRIEF DESCRIPTION OF THE DRAWING

The above objects and other advantages of the invention will become apparent in the following description of preferred embodiments and in the drawing wherein.

DESCRIPTION OF PREFERRED EMBODIMENTS

Figure 1:
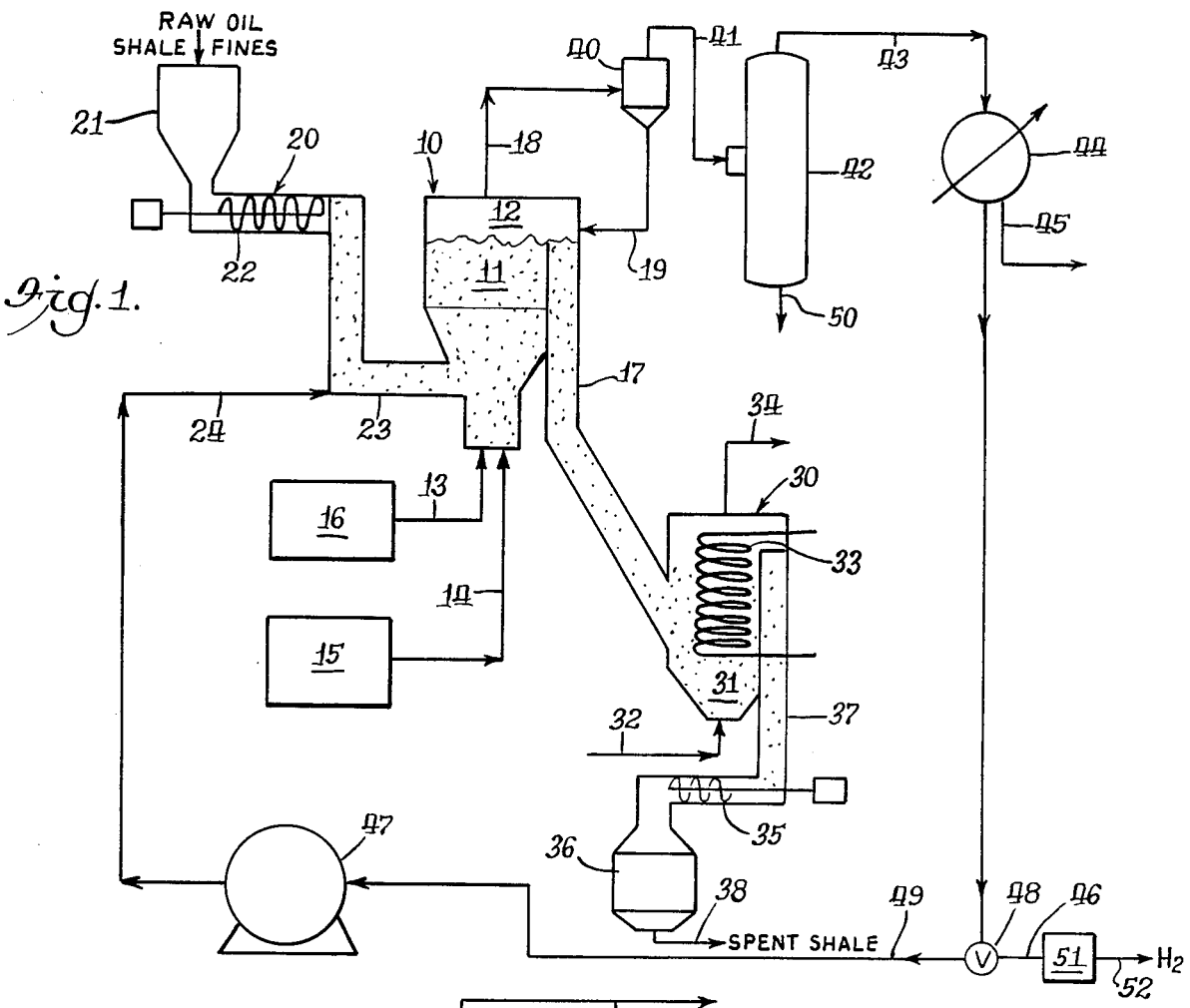
FIG. 1 schematically shows the process according to one embodiment of this invention.

The production of synthetic crude oils or fuel gases, such as synthetic natural gases, from oil shale by hydroconversion consume considerable amounts of hydrogen. Depending upon the composition of the oil shale feed stock, as much as 3,000 Standard Cubic Feet (SCF) of hydrogen per ton of shale feed stock is required for hydroconversion to oil and up to 6,000 SCF per ton of shale feed stock is required for production of gaseous hydrocarbons. Present processes contemplate production of the required hydrogen, at least partially, from the hydrocarbon gases formed in the hydroretoring process by catalytic steam reforming, or from product liquids by partial oxidation. The practice of producing hydrogen from products of the hydroconversion process results in the necessity for an increase of over about 30 percent in the hydroconversion and product upgrading capacity required for a given product output. This invention provides for production of hydrogen from raw oil shale fines produced during the grinding and sizing of run-of-mine oil shale to the sizes required for hydroconversion. Use of the raw oil shale fines for production of hydrogen in accordance with the present invention results in improvements in integrated hydroretorting plant net oil yields in the order of 20 to 25 percent, compared with prior integrated hydrogen production from hydroconversion products. Further, the passivation of raw shale fines by essentially complete removal of organic carbon and sulfur greatly reduces or eliminates potential pollution problems of acid mine drainage or leaching of the organic material into underground water, thereby facilitating land reclamation operations.

Oil shales of the Eocene period generally found in the western United States, particularly the northwestern area of Colorado and in the adjoining areas of Utah and Wyoming are suitable for use in this invention. These oil shales have an organic carbon to hydrogen weight ratio typically of about 7/1 to 8/1 and Modified Fischer Assay of greater than 25 gallons of oil per ton. Oil shales having these properties, regardless of geographical location, will be referred to as "western" oil shales. Oil shales of the Devonian and Mississippian period generally found in the eastern United States, especially in Ohio, Kentucky, Tennessee and Indiana are particularly preferred for use in this invention. These oil shales have an organic carbon to hydrogen weight ratio typically in the order of 10/1 up to about 13/1 and Modified Fischer Assays of less than 10 gallons of oil per ton and frequently as low as less than 5 gallons of oil per ton. Oil shales having these properties, regardless of geographical location, will be referred to as "eastern" oil shales. The Modified Fischer Assays have been found to not represent the organic carbon actually present in the "eastern" type shale having the higher organic carbon to hydrogen weight ratios. It has also been found that the Modified Fischer Assay values of some "eastern" oil shales change (decrease) with storage after mining. Further, the inorganic carbon present in the "eastern" type oil shales is lower than that of the "western" type oil shales by a factor of greater than 10 and up to 30 to 40. The following table gives estimated compositions of both the organic and inorganic portions of a typical "eastern" and "western" oil shale.

TABLE I

| | Source of Oil Shale | |
|---|---|---|
| | Clark County, Ind. (Eastern) | Colorado (Western) |
| | Weight Percent | |
| Organic | | |
| Carbon | 13.7 | 13.6 |
| Hydrogen | 1.2 | 1.9 |
| Sulfur | 0.3 | 0.3 |
| Nitrogen | 0.4 | 0.5 |
| Oxygen | 1.0 | 1.7 |
| Carbon/Hydrogen | 11.4 | 7.2 |
| Inorganic | | |
| Carbon Dioxide | 0.5 | 15.9 |
| Water | 4.0 | 1.8 |
| Sulfur | 4.4 | 0.2 |
| Ash | 78.3 | 66.8 |
| Modified Fischer Assay gal/ton | 10 | 30 |

The excess of the totals over 100 percent is due to weight gain by oxidation of constituents in the mineral component during ashing. It is readily observed from Table I that while the organic carbon content of the two oil shales is almost identical, the Modified Fischer Assay varies by a factor of 3. Oil shale having the properties set forth above as typical of "eastern" shale are particularly preferred for use in the process of this invention. Problems of mineral carbonate decomposition and coking are greatly reduced with "eastern" type oil shale.

The oil shale fines suitable for use in this invention have average diameters less than about 0.125 inch and may be ground for use in the process of this invention or may be the residue of grinding oil shale for principal use in other processes.

Referring to Fig; 1, showing a suitable commercial embodiment, raw oil shale fines are provided to pressurized feed means 20 which is shown as pressurized lockhopper 21 and screw feed means 22 providing the oil shale fines to dilute phase conveying line 23. In preferred embodiments, the oil shale fines are introduced at ambient temperatures. Dilute phase conveying line 23 conveys the raw oil shale fines to fluidized reaction bed 11 within fluidized reactor 10 by recycled pressurized synthesis gas from recycle pressurized synthesis gas conduit 24 introduced into dilute phase conveying line 23. The recycled synthesis gas in product gas recycle conduit 49 is pressurized by compressor 47 to provide pressurized recycle synthesis gas for conveyance of the oil shale fines in dilute phase conveying line 23. The oil shale fines are introduced into the lower portion of fluidized reaction bed 11. Fluidized reactor 10 is tapered in its lower portion to prevent solids fall-out and has solids disengagement space 12 in its upper portion to reduce solids entrainment. The oil shale fines are fluidized in fluidized bed 11 by the upward passage of recycle synthesis gas from conduit 24, superheated steam at about 500° F. passed from steam supply means 16 through steam supply conduit 13, and oxygen produced in air separation-oxygen supply means 15 and introduced through oxygen supply conduit 14.

Introduction of the raw oil shale directly into the hot fluidized bed, contrary to prior teachings regarding treatment of oil shales, is desired in the process of this invention to insure rapid heating. We have found that such rapid heat-up increases direct production of hydrogen and reduces production of undesired oils and hydrocarbon gases from the shale. It is preferred to introduce the raw oil shale fines cirectly into the lower portion of the fluidized reaction bed. While FIG. 1 shows conveyance of the oil shale fines into the fluidized bed by means of recycle of a portion of the product gas, the oil shale fines may be similarly introduced into the fluidized reaction bed in a slurry of any liquid having a latent heat of less than about 600 Btu per pound. When introduced in this fashion the liquid is evaporated below 600° F. and rapid heat-up of the oil shale through the 600°-1100° F. temperature range is assured. The ratio of feed steam to organic carbon in the shale should be maintained at about 0.1 to about 10, preferably about 0.2 to 0.6. The amount of oxygen introduced is less than the stoichiometric quantity which would be necessary for complete combustion of the organic carbonaceous kerogen content of the oil shale and preferably the oxygen is introduced in an amount of about 30 to about 70 percent of the stoichiometric quantity for complete combustion of the organic carbonaceous kerogen, and most preferably about 30 to about 50 percent of the stoichiometric quantity. Fluidized reaction bed 11 is maintained at temperatures of about 1200° to about 2000° F. and preferably at about 1300° to about 1500° F. for high conversion to hydrogen and synthesis gas with shale fines residence time in the fluidized reaction bed of about 5 to about 90 minutes, about 10 to about 30 minutes being preferred. The high conversion of organic carbon, especially to hydrogen, at the lower preferred temperatures is unexpected and particularly advantageous in preventing fusing of the ash. The desired temperatures are maintained by combustion within the fluidized bed. Pressures are not important to the process of this invention and may be from about atmospheric to about 1000 psig, pressures compatible with hydroconversions in an integrated plant being preferred in the range of about 100 to about 500 psig for "western" type oil shale and about 500 to about 1000 psig for "eastern" type oil shale.

In the practice of this invention in a continuous fluidized bed unit, the partial combustion reactions provide the desired temperature to the bed near the oxygen introduction location and the steam-carbon reaction occurs throughout the bed.

Hot solids are withdrawn from the fluidized reaction bed 11 through dense phase overflow conduit 17 transferring the spent shale to boiler 30. As shown in FIG. 1, boiler fluidized bed 31 is maintained by fluidizing air from air supply conduit 32 which is released through off-gas conduit 34. Heat exchanger 33 is surrounded by fluidized bed 31 providing good sensible heat recovery from the spent shale. Fluidization of boiler fluidized bed with air oxidizes any amounts of sulfur and organic carbon remaining in the spent shale. Boiler 30 operates at about 500° F. and heat exchanger 33 may be utilized to provide superheated steam to steam supply means 16 or for other process steam requirements. Off-gas in off-gas conduit 34 contains sulfur oxides which may be recovered by mixing with acid gas from the synthesis gas purification. Relatively cool spent shale is withdrawn from boiler fluidized bed 31 through dense phase overflow conduit 37 and passed by feed means 35 to lockhopper 36 from which it is locked out to atmospheric pressure through spent shale discharge conduit 38.

The gaseous products from fluidized reaction bed 11 are withdrawn from fluidized reactor 10 through raw product gas conduit 18 to solids separator 40 with the solids being returned to the reactor through solids recycle conduit 19 and the product gases passed to waste heat boiler 42 by product gas conduit 41. In waste heat boiler 42, the hot product gases are cooled to about 500° F. producing steam which is withdrawn through steam conduit 50 for passage to steam supply means 16 or other use in the process. The gas is then passed through conduit 43 to cooler-condenser 44 where water is condensed from the gas and gas is cooled to about 100° F. in secondary condenser 44. Waste water is removed through waste water conduit 45 and product gas is passed through product gas conduit 46 to control valve 48 wherein the product gas is divided into recycle gas passed through product gas recycle conduit 49 and raw product gas for further purification and treatment through product gas conduit 46 to purification means 51. Purification means 51 may include any suitable purification or upgrading for the production of the desired product hydrogen gas as known to the art. For example, the raw product gas may first be treated in an acid gas removal plant where it is scrubbed with hot $K_2CO_3$ solution to remove $CO_2$ and $H_2S$ followed by a water-gas shift plant to convert the CO in the gas to $H_2$ and $CO_2$ using a low temperature shift catalyst to promote the reaction. Final $CO_2$ removal may be achieved by using hot $K_2CO_3$ solution and product hydrogen withdrawn from the system through hydrogen conduit 52.

Figure 2:
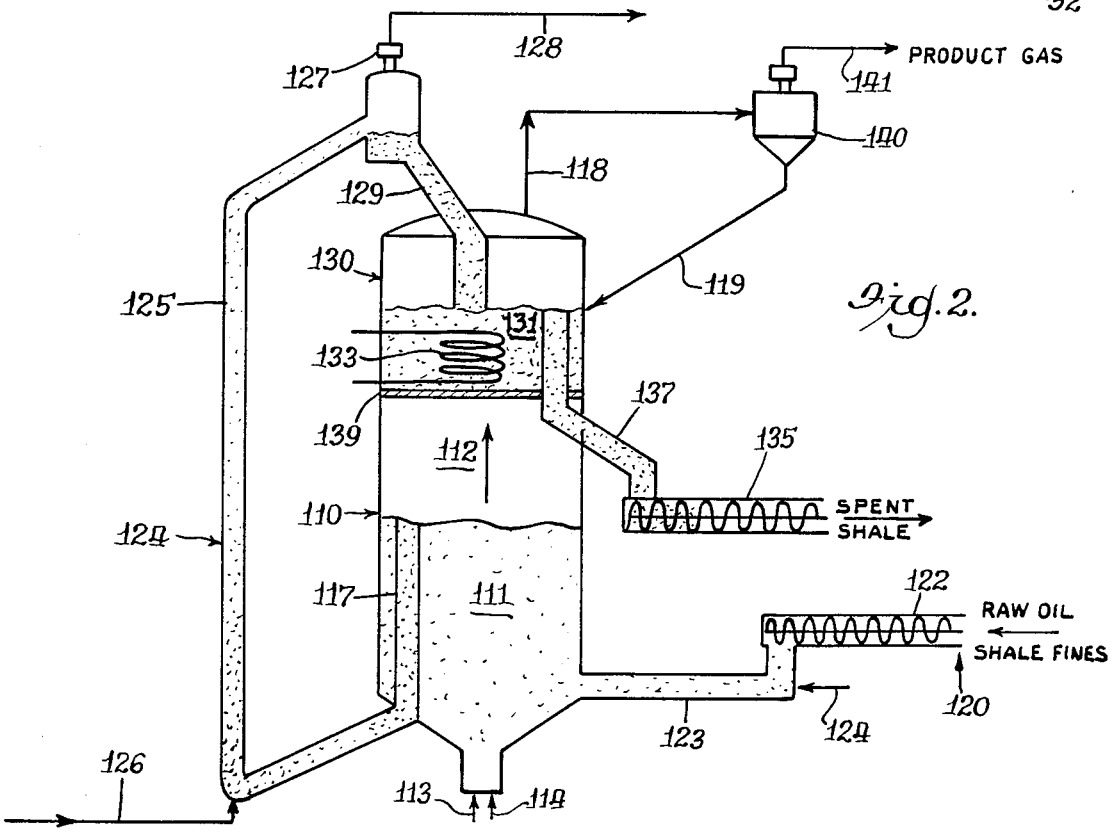
FIG. 2 schematically shows another embodiment of a process of this invention providing heat recovery from both product gas and spent shale in a single fluidizing stream.

FIG. 2 shows another suitable commercial embodiment of this invention combining heat recovery systems for the product gas and the spenf shale in a single fluidized bed heat exchanger. This embodiment provides the heat recovery systems and the reaction fluidized bed within a single pressure vessel, thereby providing savings in capital equipment expenses. FIG. 2 shows a single reaction vessel having a lower fluidized reaction portion 110 with fluidized reaction bed 111 and an upper boiler portion 130 with boiler fluidized bed 131 supported on fluidized bed support 139. In similar fashion to that shown in FIG. 1, raw oil shale fines are supplied directly into the lower portion of fluidized reaction bed 111 by pressurized feed means 120 including screw feed means 122 through dilute phase conveying line 123 with conveyance being effected by recycled synthesis gas introduced through recycle pressurized synthesis gas conduit 124. Steam supply conduit 113 and oxygen supply conduit 114 provide upward flow of these gases for fluidization of fluidized reaction bed 111. Shale fines from the top of fluidized reaction bed 111 are removed through dense phase overflow conduit 117 and lifted upwardly by air or steam lift gas introduced through conduit 126. Recycle pressurized synthesis gas also aids in lifting the shale fines by introduction through recycle pressurized synthesis gas conduit 124 into lean phase lift line 125 emptying into solids/gas disengaging vessel 127. Off-gas from solids/gas disengaging vessel 127 is removed through off-gas conduit 128 and hot shale is introduced into boiler fluidized bed 131 through conduit 129. Product gas from fluidized reaction bed 111 passes upwardly through solids disengagement space 112 and maintains boiler fluidized bed 131 in fluidized condition. Heat exchanger 133 is provided within fluidized bed 131 for heat recovery from both the shale solids and the product gas. Sensible heat is recovered in heat exchanger 133 and cooled spent shale at about 500° F. is removed from boiler fluidized bed 131 through dense phase overflow conduit 137 and conveyed by feed means 135 to a lockhopper for discharge as described with respect to FIG. 1. Product gas is withdrawn from the upper portion of reaction vessel 110 through product gas conduit 118 to solids separator 140 with solids being returned to the reactor through solids recycle conduit 119 and product gases withdrawn by product gas conduit 141 and processed in the same fashion as described with respect to the process of FIG. 1 to provide recycle gas and hydrogen.

It is thus seen that the process of the present invention utilizes oil shale fines for the primary purpose of manufacturing hydrogen. The process provides high conversion of the organic carbon of the oil shale. In specific embodiments as shown, heat recovery from both the product gas and the spent shale may be achieved to provide steam or other process heat required in this or an associated process. The process of this invention provides particular advantage when integrated with hydrogen conversion processes of the organic carbon component of oil shale to useful liquid and gaseous hydrocarbon fuels. The process of this invention provides hydrogen for such hydrogen conversion processes thereby resulting in higher desired product net production than prior processes which utilized a portion of the produced gases to make hydrogen.

The following specific examples are set forth to illustrate the chemistry of the process of this invention and are not intended to limit the invention in any way.

EXAMPLES I–V

A bench scale batch 1 inch tubular reactor was used to react Kentucky New Albany oil shale, a Devonian Age oil shale in Examples I, II and III, and Colorado oil shale, an Eocene period oil shale in Examples IV and V, with a steam/nitrogen mixture in the ratio 75/25 volume-percent to provide a non-condensible carrier gas and to simulate the synthesis gas environment of a full size reactor. The tubular reactor was electrically heated to the indicated temperature. The tubular reactor was provided with pressurized steam/nitrogen and oxygen supply at the bottom and shale solids feed and product gas removal at the top.

The reactor and steam generator were brought to operating temperatures and pressures and steam/nitrogen flow was established. Oil shale having an average size −6+10 U.S. Standard Sieve mesh and analysis shown in the Table was charged into a lock hopper and purged by pressurizing and depressurizing several times with nitrogen. The feed hopper was pressurized 50 psi above reactor pressure and the shale fed into the reactor. The oil shale was soaked in the steam/nitrogen for the time, temperature and pressure indicated and the product gas composition and flow rate analyzed. Oxygen was then introduced slowly into the reactor for the indicated time, maintaining the temperature at the point of oxygen introduction below 1800° F. The oxygen flow was continued until oxygen breakthrough. The steam/nitrogen flow was stopped and the reactor purged with nitrogen during cool down. The spent shale was removed from the reactor without any significant ash fusion and its analysis shown in the Table.

The results are shown in Table I for Examples I–V.

TABLE I

| | "Eastern" Oil Shale | | | | | | "Western" Oil Shale | | | |
|---|---|---|---|---|---|---|---|---|---|---|
| EXAMPLE | I | | II | | III | | IV | | V | |
| Operating Pressure, psig | 500 | | 110 | | 110 | | 500 | | 100 | |
| Average Bed Temperature, °F. | 1510 | | 1450 | | 1490 | | 1380 | | 1320 | |
| Gas Composition, mol % | Soak Before $O_2$ | After $O_2$ | Soak Before $O_2$ | After $O_2$ | Soak Before $O_2$ | After $O_2$ | Soak Before $O_2$ | After $O_2$ | Soak Before $O_2$ | After $O_2$ |
| CO | 1.2 | 3.3 | 8.7 | 4.8 | 1.5 | 1.9 | 1.4 | 4.7 | 1.3 | 0.9 |
| $CO_2$ | 1.0 | 9.3 | 6.1 | 10.4 | 1.5 | 34.5 | 3.7 | 0.1 | 1.0 | 11.1 |
| $H_2$ | 8.0 | 16.3 | 25.8 | 28.0 | 10.4 | 10.2 | 4.3 | 11.6 | 6.2 | 13.5 |
| $CH_4$ | 6.9 | 4.7 | 7.2 | 2.1 | 20.6 | 3.1 | 10.1 | 6.5 | 30.7 | 6.5 |
| $C_2H_4$ | 1.4 | 0.7 | 0.3 | 0.1 | 1.7 | 0.1 | 2.7 | 1.3 | 1.3 | 2.0 |
| $N_2$ | 81.8 | 66.0 | 52.4 | 55.1 | 63.8 | 50.4 | 78.7 | 76.2 | 62.0 | 67.3 |
| $H_2S$ | — | — | 0.1 | — | 1.5 | 1.0 | — | — | — | — |
| | 100.3 | 100.3 | 100.6 | 100.5 | 101.0 | 101.2 | 100.9 | 100.4 | 102.5 | 101.3 |
| Product Gas Flow Rate, SCFH | 2.20 | 3.63 | 2.190 | 3.24 | 1.94 | 2.70 | 3.12 | 5.10 | 2.16 | 3.42 |
| Time, min. | 30 | 20 | 35 | 25 | 30 | 30 | 30 | 10 | 30 | 20 |
| Shale Composition, wt % | Raw | Spent | Raw | Spent | Raw | Spent | Raw | Spent | Raw | Spent |
| C | 13.87 | 1.03 | 14.87 | 1.73 | 13.87 | 1.52 | 16.25 | 0.14 | 16.25 | 0.15 |
| H | 1.64 | 0.06 | 1.64 | 0.11 | 1.64 | 0.11 | 2.26 | 0.06 | 2.26 | 0.09 |
| N | 0.49 | 0.06 | 0.49 | 0.00 | 0.49 | 0.00 | 0.43 | 0.00 | 0.43 | 0.00 |
| S | 5.15 | 2.71 | 5.15 | 2.43 | 5.15 | 2.44 | 0.81 | 0.37 | 0.81 | 0.44 |
| $CO_2$ | 2.12 | 0.24 | 2.12 | 0.05 | 2.12 | 0.41 | 18.58 | 0.22 | 18.58 | 1.03 |
| Ash | 75.73 | 96.69 | 75.73 | 95.77 | 75.73 | 95.15 | 60.54 | 98.77 | 60.54 | 97.26 |
| Weight, lbs | 0.253 | 0.1947 | 0.253 | 0.2211 | 0.256 | 0.226 | 0.253 | 0.152 | 0.253 | 0.162 |
| Yield, SCF/ton | | | | | | | | | | |
| $H_2$ - Equivalent (CO + $H_2$) | 799 | 1870 | 3479 | 3496 | 902 | 1276 | 703 | 1095 | 640 | 1298 |
| $CH_4$ - equivalent HC Gas | 842 | 582 | 787 | 245 | 1818 | 348 | 1911 | 611 | 2843 | 946 |

TABLE I-continued

| EXAMPLE | "Eastern" Oil Shale I | | "Eastern" Oil Shale II | | "Eastern" Oil Shale III | | "Western" Oil Shale IV | | "Western" Oil Shale V | |
|---|---|---|---|---|---|---|---|---|---|---|
| Total $H_2$ equivalent | 4167 | 4198 | 6627 | 4476 | 8177 | 2668 | 8347 | 3540 | 12012 | 5082 |
| ($CO + H_2 + HC$'s) | 8365 | | 11103 | | 10845 | | 11887 | | 17094 | |
| Organic carbon conversion, % (by ash balance) | 94 | | 90 | | 91 | | 99 | | 99 | |

EXAMPLE VI

Computations were made utilizing Kentucky New Albany shale in an apparatus as shown in FIG. 1. The shale of a size minus 0.125 inch, average size 26 mesh, is fed to lockhopper 21 and the system elevated to a pressure of about 100 psig. The shale is fed to a reactor fluidized bed 11 considered to be 35 feet in diameter and 10 feet deep. The solids are maintained fluidized by recycled snythesis gas, superheated steam at 500° F. and oxygen. Hot shale, about 1600° F., is continuously withdrawn from the reactor fluidized bed after an average residence time of about 30 minutes. The hot shale passes from the reactor fluidized bed into boiler fluidized bed 31. Boiler 30 is considered to be 12 feet in diameter with a 35 foot deep bed fluidized with air which oxidizes sulfur and organic carbon remaining in the shale. Boiler 30 operates at about 500° F. and generates steam in heat exchanger 33. The off gas in conduit 34 contains $SO_2$ which is passed with product acid gas from cooler-condenser 44 to a Claus plant for sulfur recovery and ammonia recovery. The hot product gas from the reactor after passing through solids separator 40 passes through boiler 42 where it is cooled to about 500° F. by heat transfer which produces steam and then cooled to about 100° F. in cooler-condenser 44. A minor portion of the product gas is recycled to reactor 10 and a major portion passes to an acid-gas removal plant and is scrubbed with hot $K_2CO_3$ solution to remove $CO_2$ and $H_2S$. Sweet gas then flows to a water-gas shift plant reacting the CO in the gas with steam in the presence of a low temperature shift catalyst to produce $H_2$ and $CO_2$. $CO_2$ is removed using hot $K_2CO_3$ solution and the product hydrogen gas withdrawn.

Calculations show 11,560 SCF of hydrogen can be produced from one ton of Kentucky New Albany shale by the above process. $1.3\times10^6$ Btu of process fuel per ton of shale is required for steam production and utilities. The calculated overall thermal efficiency of the process is 52 percent, including both raw shale and external heat.

Calculations for production of liquid hydrocarbon products from Kentucky New Albany oil shale by hydrogen-retorting as taught by U.S. Pat. Nos. 3,922,215 and 4,003,821 show the requirement of $390\times10^6$ SCF/day of hydrogen to produce 66,164 barrels/day of synthetic crude oil from 110,000 tons/day of run-of-mine oil shale. Plant utility fuel and firing steam reformers for hydrogen manufacture requires 19,950 barrels/day, leaving a net product of 46,214 barrels/day synthetic crude oil. Approximately 17,386 tons/day of the run-of-mine feed shale is discarded as fines. The net synthetic crude oil yield without use of integrated hydrogen production according to this invention is 0.420 barrels/ton of run-of-mine oil shale.

Combination of the hydrogen production process of this invention with the above synthetic crude oil production process requires mining 126,352 tons/day oil shale of which 33,738 tons/day is fed to the hydrogen production process and 92,614 tons/day is fed to the hydrogen-retorting process. All shale fines are used in the hydrogen production process. The integrated processes produce net synthetic crude oil product of 66,164 barrels/day and about $10\times10^6$ SCF/day methane equivalent hydrocarbon gas. The net synthetic crude oil yield integrating the hydrogen production process of this invention in oil shale hydrogen-retorting is 0.524 barrels/ton of run-of-mine oil shale. This is an improvement in yield of synthetic crude oil of nearly 25 percent.

Calculations show that omission of the fluidized bed heat recovery boiler in the hydrogen production process reduces the improvement to about 20 percent.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for the production of hydrogen from oil shale fines comprising:

introducing raw oil shale fines having average diameters less than about 0.125 inch directly into a fluidized reaction bed maintained within a reaction vessel, said bed having temperatures about 1200° to about 2000° F. providing rapid heat-up of said oil shale fines;

fluidizing said reaction bed by upward passage of steam and oxygen, said steam being introduced in the weight ratio of about 0.1 to about 10 on the basis of the organic carbon content of said oil shale and said oxygen being introduced in less than the stoichiometric quantity for complete combustion of the organic carbonaceous kerogen content of said oil shale;

reacting said steam and oxygen with the organic carbon components of said oil shale producing spent shale and product gas comprising hydrogen and carbon monoxide; and withdrawing said product gas separately from spent shale.

2. The process of claim 1 wherein said shale fines are introduced into the lower portion of said fluidized reaction bed.

3. The process of claim 1 wherein said shale fines are introduced into said fluidized reaction bed by means comprising recycle of a portion of said product gas.

4. The process of claim 1 wherein said shale fines are introduced into said fluidized reaction bed in a slurry of a liquid having a latent heat of less than about 600 Btu/lb.

5. The process of claim 1 wherein said fluidized reaction bed temperatures are about 1300° to about 1500° F.

6. The process of claim 1 wherein the pressure within said reaction vessel is about atmospheric to about 1000 psig.

7. The process of claim 1 wherein the pressure within said reaction vessel is about 100 to 500 psig.

8. The process of claim 1 wherein said shale fines are at about an ambient temperature when introduced into said fluidized reaction bed.

9. Tne process of claim 1 wherein said steam is introduced in the weight ratio of about 0.2 to about 0.6 on the basis of the organic carbon content of said oil shale.

10. The process of claim 1 wherein said oxygen is introduced in an amount of about 30 to about 70 percent of the stoichiometric quantity for complete combustion of said organic carbonaceous kerogen.

11. The process of claim 1 wherein said oxygen is introduced in an amount of about 30 to about 50 percent of the stoichiometric quantity for complete combustion of said organic carbonaceous kerogen.

12. The process of claim 1 wherein said shale fines residence time in said fluidized reaction bed is about 5 to about 90 minutes.

13. The process of claim 1 wherein said shale fines residence time in said fluidized reaction bed is about 10 to about 30 minutes.

14. The process of claim 1 wherein said spent shale is passed from said fluidized reaction bed to a fluidized heat recovery bed, said heat recovery bed being in thermal exchange relation with a heat exchanger capable of absorbing heat.

15. The process of claim 14 wherein said fluidized heat recovery bed is fluidized with air.

16. The process of claim 14 wherein said fluidized heat recovery bed is fluidized with said product gas providing heat transfer to said heat exchanger from both said spent shale and said product gas.

17. The process of claim 16 wherein said fluidized heat recovery bed is supported on a fluidized bed support above and within the sam reaction vessel as said fluidized reaction bed.

18. The process of claim 17 wherein said spent shale is passed to said fluidized heat recovery bed by means comprising recycle of a portion of said product gas.

19. The process of claim 1 wherein said product gas carbon monoxide is catalytically converted to hydrogen.

20. The process of claim 1 providing removal of residual sulfur and organic compounds from said shale providing relatively sulfur and organic carbon free spent shale.

21. The process of claim 1 wherein greater than about 90 percent of the organic carbon component of said oil shale fines is converted to said product gas.

22. A process for the production of hydrogen from oil shale fines comprising:

introducing raw oil shale fines having a Modified Fischer Assay of less than about 10 and average diameters less than about 0.125 inch directly into a fluidized reaction bed maintained within a reaction vessel, said bed having temperatures about 1200° to about 2000° F. providing rapid heat-up of said oil shale fines;

fluidizing said reaction bed by upward passage of steam and oxygen, said steam being introduced in the weight ratio of about 0.1 to about 10 on the basis of the organic carbon content of said oil shale and said oxygen being introduced in less than the stoichiometric quantity for complete combustion of the organic carbonaceous kerogen content of said oil shale;

reacting said steam and oxygen with the organic carbon components of said oil shale producing spent shale and product gas comprising hydrogen and carbon monoxide; and withdrawing said product gas separately from said spent shale.

23. The process of claim 22 wherein said oil shale fines have an organic carbon to hydrogen weight ratio of about 10/1 to about 13/1.

24. The process of claim 22 wherein said shale fines are introduced into the lower portion of said fluidized reaction bed.

25. The process of claim 22 wherein said shale fines are introduced into said fluidized reaction bed by means comprising recycle of a portion of said product gas.

26. The process of claim 22 wherein said shale fines are introduced into said fluidized reaction bed in a slurry of a liquid having a latent heat of less than about 600 Btu/lb.

27. The process of claim 22 wherein said fluidized reaction bed temperatures are about 1300° to about 1500° F.

28. The process of claim 22 wherein the pressure within said reaction vessel is about atmospheric to about 1000 psig.

29. The process of claim 22 wherein the pressure within said reaction vessel is about 500 to about 1000 psig.

30. The process of claim 22 wherein said shale fines are at about an ambient temperature when introduced into said fluidized reaction bed.

31. The process of claim 22 wherein said steam is introduced in the weight ratio of about 0.2 to about 0.6 on the basis of the organic carbon content of said oil shale.

32. The process of claim 22 wherein said oxygen is introduced in an amount of about 30 to about 70 percent of the stoichiometric quantity for complete combustion of said organic carbonaceous kerogen.

33. The process of claim 22 wherein said oxygen is introduced in an amount of about 30 to about 50 percent of the stoichiometric quantity for complete combustion of said organic carbonaceous kerogen.

34. The process of claim 22 wherein said shale fines residence time in said fluidized reaction bed is about 5 to about 90 minutes.

35. The process of claim 22 wherein said shale fines residence time in said fluidized reaction bed is about 10 to about 30 minutes.

36. The process of claim 22 wherein said spent shale is passed from said fluidized reaction bed to a fluidized heat recovery bed, said heat recovery bed being in thermal exchange relation with a heat exchanger capable of absorbing heat.

37. The process of claim 36 wherein said fluidized heat recovery bed is fluidized with air.

38. The process of claim 36 wherein said fluidized heat recovery bed is fluidized with said product gas providing heat transfer to said heat exchanger from both said spent shale and said product gas.

39. The process of claim 38 wherein said fluidized heat recovery bed is supported on a fluidized bed support above and within the same reaction vessel as said fluidized reaction bed.

40. The process of claim 39 wherein said spent shale is passed to said fluidized heat recovery bed by means comprising recycle of a portion of said product gas.

41. The process of claim 22 wherein said product gas carbon monoxide is catalytically converted to hydrogen.

42. The process of claim 22 providing removal of residual sulfur and organic compounds from said shale providing relatively sulfur and organic carbon free spent shale.

43. The process of claim 22 wherein greater than about 90 percent of the organic carbon component of said oil shale fines is converted to said product gas.

44. The process of claim 22 or 23 wherein said oil shale fines have a Modified Fischer Assay of less than about 5.

45. The process of claim 1 for production of hydrogen from oil shale fines comprising grinding and sizing run-of-mine shale producing a size for an oil shale hydroliquefaction process and fines, feeding said oil shale sized for hydroliquefaction process and said produced hydrogen from said oil shale fines to said oil shale hydroliquefaction process, said combined processes of hydrogen production and hydroliquefaction resulting in an overall process efficiency increase in production of liquid product of greater than about 15 percent on the basis of run-of-mine oil shale.

46. The process of claim 1 for production of hydrogen from oil shale fines comprising grinding and sizing run-of-mine shale producing a size for an oil shale hydrogasification process and fines, feeding said oil shale sized for hydrogasification process and said produced hydrogen from said oil shale fines to said oil shale hydrogasification process, said combined processes of hydrogen production and hydrogasification resulting in an overall process efficiency increase in production of gas product of greater than about 15 percent on the basis of run-of-mine oil shale.

47. The process of claim 22 for production of hydrogen from oil shale fines comprising grinding and sizing run-of-mine shale producing a size for an oil shale hydroliquefaction process and fines, feeding said oil shale sized for hydroliquefaction process and said produced hydrogen from said oil shale fines to said oil shale hydroliquefaction process, said combined processes of hydrogen production and hydroliquefaction resulting in an overall process efficiency increase in production of liquid product of greater than about 15 percent on the basis of run-of-mine oil shale.

48. The process of claim 22 for production of hydrogen from oil shale fines comprising grinding and sizing run-of-mine shale producing a size for an oil shale hydrogasification process and fines, feeding said oil shale sized for hydrogasification process and said produced hydrogen from said oil shale fines to said oil shale hydrogasification process, said combined processes of hydrogen production and hydrogasification resulting in an overall process efficiency increase in production of gas product of greater than 15 percent on the basis of run-of-mine oil shale.

* * * * *